US005587551A

United States Patent [19]

Ikegawa et al.

[11] Patent Number: 5,587,551

[45] **Date of Patent: *Dec. 24, 1996**

[54] DEVELOPING APPARATUS

[75] Inventors: Akihito Ikegawa, Sakai; Kouichi Aritomo, Itami; Kazuki Tsukamoto, Katano; Michiya Yamashita, Itami, all of Japan

[73] Assignee: Minolta Camera Kabushiki Kaisha, Osaka, Japan

[ * ] Notice: The term of this patent shall not extend beyond the expiration date of Pat. No. 5,338,895.

[21] Appl. No.: 542,299

[22] Filed: Oct. 12, 1995

Related U.S. Application Data

[60] Continuation of Ser. No. 233,525, Apr. 26, 1994, abandoned, which is a division of Ser. No. 16,671, Feb. 11, 1993, Pat. No. 5,338,895, which is a continuation of Ser. No. 552,069, Jul. 13, 1990, abandoned.

[30] Foreign Application Priority Data

Jul. 17, 1989 [JP] Japan ..... 1-185266

[51] Int. Cl.[6] ..... G03G 15/00

[52] U.S. Cl. ..... 118/661; 355/259

[58] Field of Search ..... 355/215, 245, 355/251–253, 259, 261; 118/647, 651, 653, 656–658, 661

[56] References Cited

U.S. PATENT DOCUMENTS

| | | | |
|---|---|---|---|
| 4,538,898 | 9/1985 | Kanno et al. | 118/657 |
| 4,566,402 | 1/1986 | Shimazaki | 118/653 |
| 4,733,267 | 3/1988 | Enoki et al. | 355/253 |
| 4,806,981 | 2/1989 | Ishiguro et al. | 355/299 X |
| 4,866,480 | 9/1989 | Hosoya et al. | 355/245 |
| 4,895,105 | 1/1990 | Kubo et al. | 118/658 |
| 4,908,291 | 3/1990 | Fuma et al. | 118/657 X |
| 4,920,916 | 5/1990 | Mizuno et al. | 118/653 |
| 5,073,797 | 12/1991 | Ono et al. | 355/215 |
| 5,338,895 | 8/1994 | Ikegawa et al. | 118/661 |

FOREIGN PATENT DOCUMENTS

| | | |
|---|---|---|
| 62-17774 | 1/1987 | Japan . |
| 62-192770 | 8/1987 | Japan . |

*Primary Examiner*—Robert Beatty

*Attorney, Agent, or Firm*—Burns, Doane, Swecker & Mathis, LLP

[57] ABSTRACT

A developing apparatus for developing an electrostatic latent image on an electrostatic latent image carrier includes a toner tank for storing toner, a developing roller, and an agitator for supplying the toner from the toner tank to the developing roller. The apparatus further includes a regulation member having one end portion fixedly supported and other end portion being slidingly held in contact with the outer surface to define a contacting area. The regulating member is bent at an angle α outwardly from the outer surface to define a bent portion such that the bent portion is located closely adjacent to the developing roller with respect to the contacting area. The curvature radius of the bent portion is no greater than 0.5 mm and the length of the bent portion's free end is between 0.5–5.0 mm.

24 Claims, 4 Drawing Sheets

DEVELOPING APPARATUS

This application is a continuation of application Ser. No. 08/233,525, filed Apr. 26, 1994, now abandoned, which is a division of application Ser. No. 08/016,671 filed Feb. 11, 1993, issued as U.S. Pat. No. 5,338,895, and which, in turn, is a continuation of application Ser. No. 07/552,069 filed Jul. 13, 1990, now abandoned.

BACKGROUND OF THE INVENTION

1. Field of the Invention

The present invention generally relates to a developing apparatus for in use an electrophotographic copying apparatus, a printer or the like.

2. Description of the Prior Art

Many of the patents issued in various countries disclose a developing apparatus having a regulation member, which is pressed slidingly against a developing roller for the supply of the toner towards the developing process directory or indirectly. The regulation member is operable to form an electrically changed toner layer on the peripheral surface of a developing roller.

For example, Japanese Patent Application SHO 62-17774, published Jan. 26, 1987, discloses a regulation blade having a generally orthogonally bent end. An outer surface of the bent corner is pressed slidingly against a developing roller. However, because this blade is brought into a line contact with the developing roller, a nip (contact) width between the bent corner of the regulation blade and the developing roller is so small as to result in insufficient electric charging of toner. Furthermore, it is impossible to form a uniform thin layer of toner stably in service over a long time because of the influence which would be brought about by the adhesion of toner to the regulating portion of the blade.

Furthermore, U.S. Pat. No. 4,566,402 discloses the use of two regulation blades of different constructions. One blade is constructed by two pieces of elastic plates bonded at one end with each other. The other blade is constructed by a single elastic plate which is bent at center portion thereof. Both blades are slidingly pressed against the developing roller at their end portion apart from the bonded or bent portion respectively. However, each of these blades can not contact uniformly the developing roller over the entire length of the roller over because the respective blade is flexible and deformable. Therefore this hampers the uniform formation of toner layer and hence results in a varying density of copied image.

SUMMARY OF THE INVENTION

The present invention has been developed with a view to substantially eliminating the above discussed problem inherent in the prior art developing apparatus and is intended to provide an improved developing apparatus effective to provide copies of uniform image quality over a long term.

According to the present invention, a developing apparatus for developing an electrostatic latent image on an electrostatic latent image carrier comprising developer carrier means having an outer surface for carrying developer thereon and being provided rotatably, and regulating means having an end portion so disposed to oppose said developer carrier means in its rotating direction, said end portion having a contacting portion which is in area contact with the surface of said developer carrier means and a bent portion following said contacting portion which is so bent away from said developer carrier means with a curvature formed at its bent corner.

Because regulation member is brought into plane contacts with developing roller, the contact pressure per unit area is reduced and a thin layer of toner is uniformly formed with less occurrence of undesirable toner adhesion, even after a long term of use, thus after passing through the contacting area uniform thickness of thin toner layer is obtained. Thus, uniform amount of toner per unit area can be transported along the entire contact width.

BRIEF DESCRIPTION OF THE DRAWINGS

This and other objects and features of the present invention will readily be understood from the following description taken in conjunction with preferred embodiments thereof with reference to the accompanying drawings, in which.

DETAILED DESCRIPTION OF THE PREFERRED EMBODIMENTS

Figure 1:
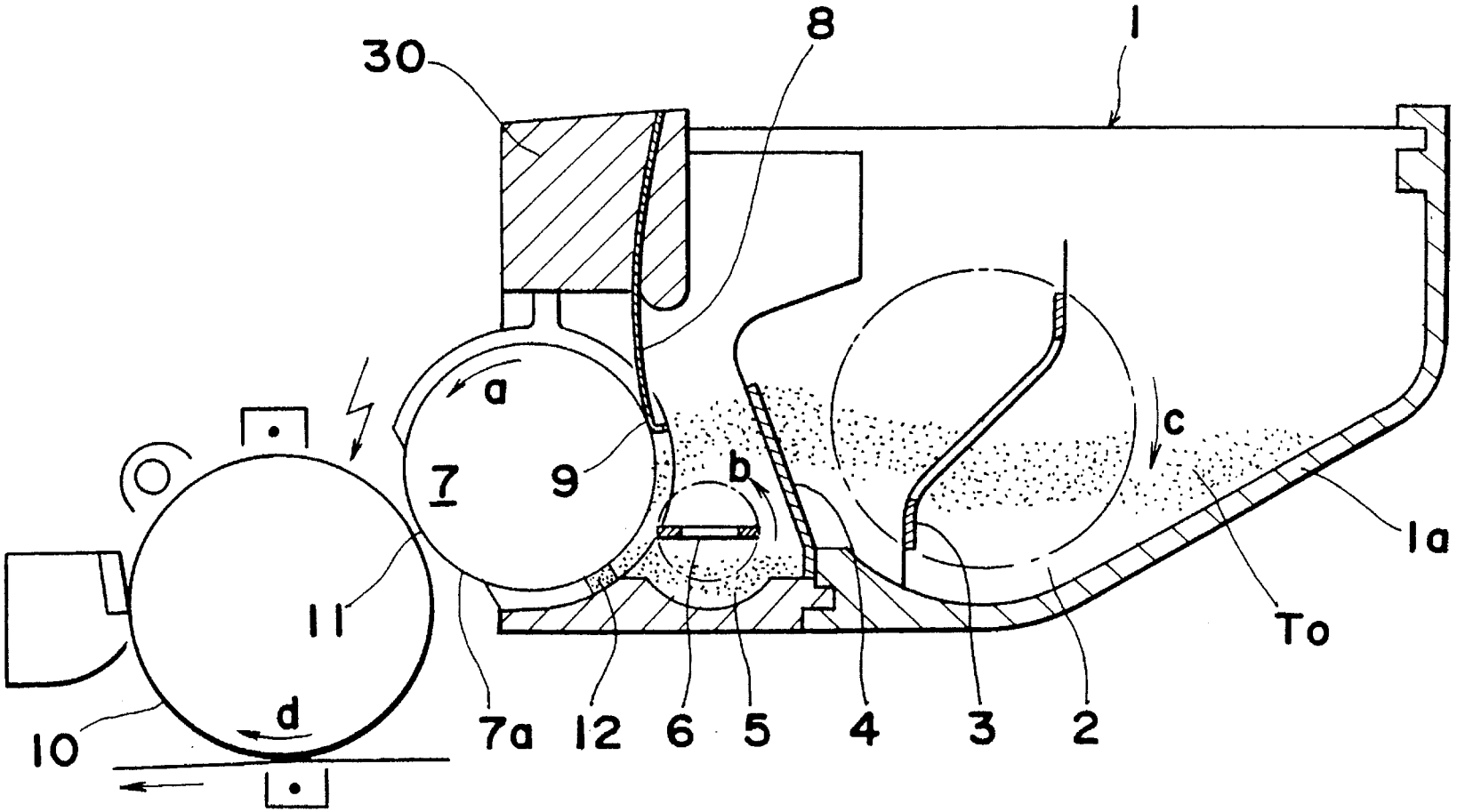
FIG. 1 is a sectional view of a developing apparatus according to the present.

Referring now to the drawings, there is shown in FIG. 1, a developing apparatus 1 for in use an electrophotographic copying apparatus, or in a printer, or the like apparatus. The developing apparatus 1 is disposed adjacent to a photosensitive drum 10 driven in a direction indicated by an arrow d.

The developing apparatus 1 includes a casing 1*a*, a support member 30 located at upper end corner of casing 1*a*, and a partition 4 which separates the casing into a toner tank 2 for storing toner To and a buffer room 5 for regulation of toner amount for developing.

Provided in the toner tank 2 is an agitator 3 for stirring the toner and sending the same to buffer room 5 as it rotates in a direction indicated by an arrow c.

Provided in the buffer room 5 are a developing roller 7 located below the support member 30, a sealing block 12 positioned beneath the developing roller 7, and a regulation member 8 having one end fixedly held by the support member 30 and other end slidingly pressed against the outer surface 7*a* of developing roller 7 for regulating the thickness of a toner layer on the roller surface 7*a* as will be described in detail later in connection with FIG. 2. Further provided in the buffer room 5 is a rotating blade 6 driven in a direction indicated by an arrow b for stirring and sending the toner towards the roller surface 7*a*.

Figure 2:
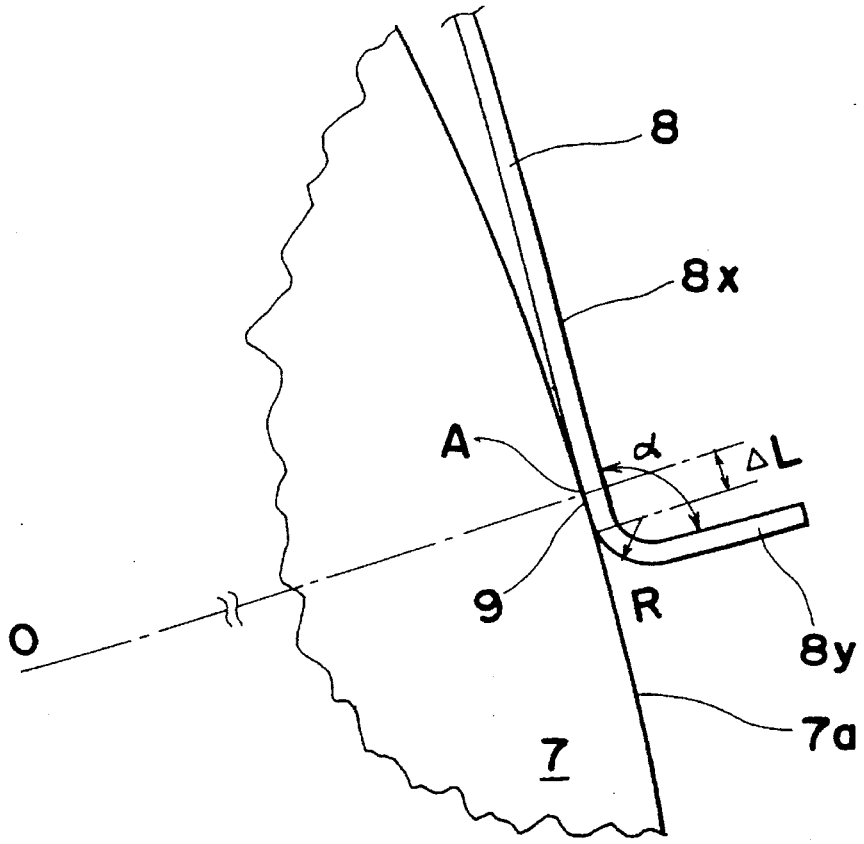
FIG. 2 is a fragmentary view showing, on an enlarged scale, a portion of regulation member of FIG. 1.

Referring to FIG. 2, the regulating member 8 has its low end portion bent at an angle α, which is about 90° in this embodiment, to provide an upright portion 8*x* which extends at about tangent direction with respect to the roller surface 7*a* and a bent portion 8*y* which extends at about radial direction outwardly from the roller surface 7*a*. A lower end portion of the upright portion 8*x* is held slidingly pressed against roller surface 7*a* so as to make a contacting area 9.

In operation, as agitator 3 rotates in direction c, the toner To stored in toner tank 2 is fed into buffer room 5 over the partition 4. In buffer room 5, the toner is delivered to roller surface 7*a* by the rotating blade 6 and is held on the roller surface 7*a*. Then, as the developing roller 7 rotates in the direction a, the toner adhered on roller surface 7*a* is carried and brought to the contacting area 9, at which the top portion of the toner is scraped off by the regulation member 8. Therefore, after the contacting area 9, the toner remaining on the roller surface 7*a* is spread with a uniform thickness to define a toner layer entirely across the roller surface 7*a* along the axial-wise direction.

More specifically, since the regulating member 8 is held in contact with the roller surface 7*a*, not in line but in area, the toner passing through the contacting area 9 is charged by the contact with the regulation member 8 and, at the same time is adhered to the roller surface 7*a*. Thus, on the roller surface 7*a* that have passed the contacting area 9, a thin layer of charged toner is formed.

Furthermore, the regulation member 8 has the bend portion 8*y* located further towards the end from the contacting area 9. Therefore, a high linearity of the regulating member 8 particularly at the contacting area 9 in the axial direction of roller 7 can be obtained. Thus, at the contacting area 9, the regulating member 8 contacts the roller surface 7*a* with a uniform pressure along the axial-wise direction of the developing roller 7. Also, since the regulating member 8 is held in contact with the roller surface 7*a* at contacting area 9 not in a line but in an area, the contacting pressure per a unit area between the regulating member 8 and roller surface 7*a* is relatively small, thereby avoiding rigid adhering of toner on the regulating member 8 or the roller surface 7*a* which may occur if the roller contacting pressure is greater than the appropriate pressure. Furthermore, with such an appropriate contacting pressure between the regulating member 8 and the roller surface 7*a*, the thin toner layer formed after passing through the contacting area 9 can be maintained constant in the axial-wise direction and also in the roller advancing direction. Thus, a constant and stable toner supply can be effected during the life time of the developing apparatus.

As noted above, the regulating member 8 makes an area contact with developing roller 7 at the contacting area 9. At this contacting area 9, the low end portion of the regulating member 8 extends for the length of ΔL from the central point A which is substantially the middle way of the area contact which the member makes at the contacting area. The bent portion 8*y* thus then further extends from the length ΔL to form a regulating passage for toner.

By the rotation of developing roller 7, the toner layer To formed at the contacting area 9 is transferred to a developing station 11 at which the roller surface 7*a* is so provided as to confront with the photosensitive drum 10. At the developing station 11, the electrically charged toner adhering on roller surface 7*a* is attracted by the electrostatic latent imaged formed on the surface of the photosensitive drum 10 by the electrostatic force to form a visible toner image which is thereafter transferred to a copy paper in a known manner.

In the meantime, the toner To remaining on the roller surface 7*a* passes through the sealing block 12 and is returned back to the buffer room 5. In the buffer room 5, the toner To consumed at the developing station is compensated to form again the thin toner layer at the contacting area 9.

Figure 3:
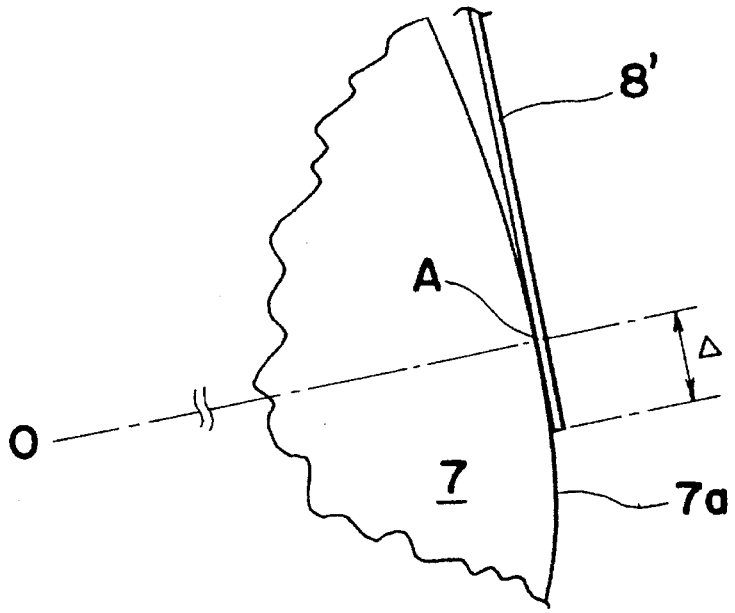
Fig. 3 PRIOR ART
FIG. 3 is a fragmentary view showing, on an enlarged scale, a portion of regulation member of the prior art.
Figure 4:
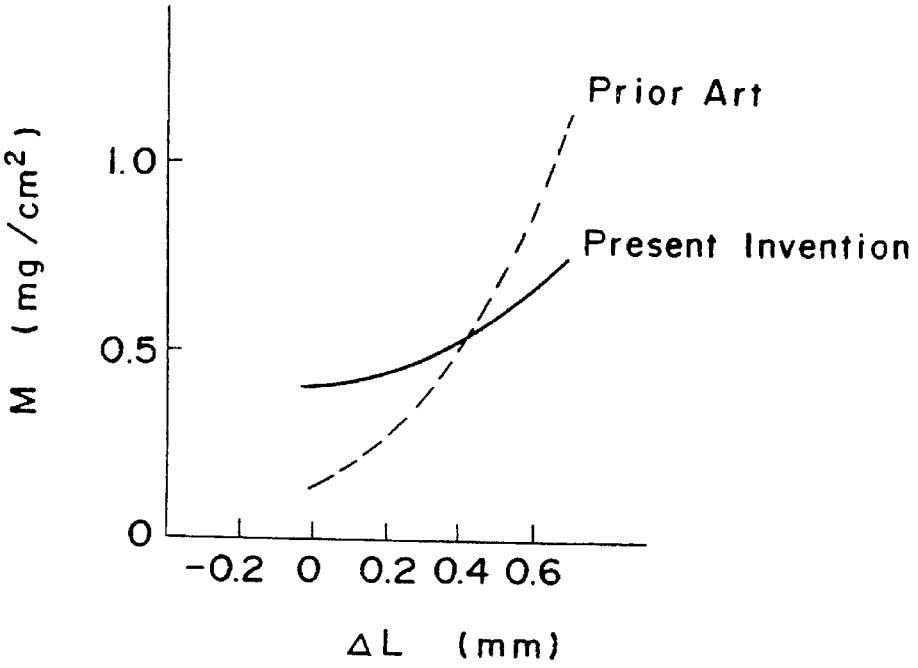
FIG. 4 is a graph showing relationship between length of the regulation member and amount of toner adhering to the toner support member of the present invention.

Referring to FIG. 4, test results are shown for the comparison between the developing apparatus of the present invention and that of the prior art. The tests are carried out to find out the change of the toner amount M (mg/cm$^2$) adhering on a unit area of roller surface 7*a* immediately after passing through the contacting area 9 with respect to the change of the length ΔL. The prior art developing apparatus used in the tests is shown in FIG. 3 which includes a regulation member 8' of straight plate having no bent portion. The length ΔL for the prior art developing apparatus is measured from central point A of contacting area to the free end of regulating member 8'. In FIGS. 2 and 3, O is the center of roller 7. The developing apparatus of the present invention used in the tests has a metallic regulating member 8 with a thickness being between 0.05 mm and 0.15 mm, the curvature radius R being less than 0.3 mm, the bent angle α being approximately 90°, and the distance from the bent corner to the end of the bent portion being 2 mm.

As apparent from the graph of FIG. 4, the solid line test results of the developing apparatus 1 according to the present invention showed relatively small change of the toner amount M (mg/cm$^2$) adhering on a unit area of roller surface 7*a* immediately after passing through the contacting area 9 with respect to the change of the length ΔL. On the contrary, the dotted line test results of the developing apparatus according to the prior art showed relatively large change of the toner amount M (mg/cm$^2$) adhering on a unit area of roller surface 7*a* immediately after passing through the contacting area 9 with respect to the change of the length ΔL.

As apparent from these test results, according to the present invention, even if the length ΔL should vary among the manufactured developing apparatuses or within a developing apparatus after a long period of use, the toner amount M (mg/cm$^2$) will not be changed greatly, resulting in unchanged and stable supply of toner to the developing station 11.

The regulation member 8 according to the preferred embodiment of the present invention may be made either by a metallic blade or a resinous blade. For the metallic type regulation member 8, stainless steel or phosphor bronze may be used. If the regulation member 8 is made by a resinous material, a synthetic resin capable of being electrostatically charged to the polarity opposite to that of the toner may be used, or alternatively a synthetic resin capable of being electrostatically charged to the same polarity as that of the toner may be used. In the latter case, the position on the triboelectric charging order table for the synthetic resin and that for the toner should be spaced away.

Furthermore, according to a preferred embodiment, the regulation member 8 has a curvature radius R of about 0.5 mm or less. If the curvature radius R is set greater than a permissible range, the amount of toner captured under the regulating member 8, i.e., at the contacting area 9, will be increased. In order to avoid such an increase of the captured toner, the contacting pressure of regulating member 8 against the roller surface 7*a* should be increased, but which in turn results in undesirable rigid adhering of toner layer on the roller surface 7*a*.

The bending angle α should preferably be between 60° and 100°. If the bending angle α is made greater than the preferable range, the amount of toner captured under the regulating member 8 will be increased, and therefore, the problem similar to that described above occurs.

The bent distance between the bent corner to the free end of the bent portion 8*y* should be between 0.5 mm and 5 mm, and preferably be between 0.5 mm and 1.5 mm. If the bent distance is made smaller than the permissible range, it will be difficult to form a uniform bent corner. If the bent distance is made longer than the permissible range, the circulation of toner in the buffer room 5 as effected by the rotating blade 6 is interrupted, resulting in collection of densely packed toner against bent portion 8*y*, in turn resulting in rigid adherence of toner on the regulating member 8.

Figure 5:
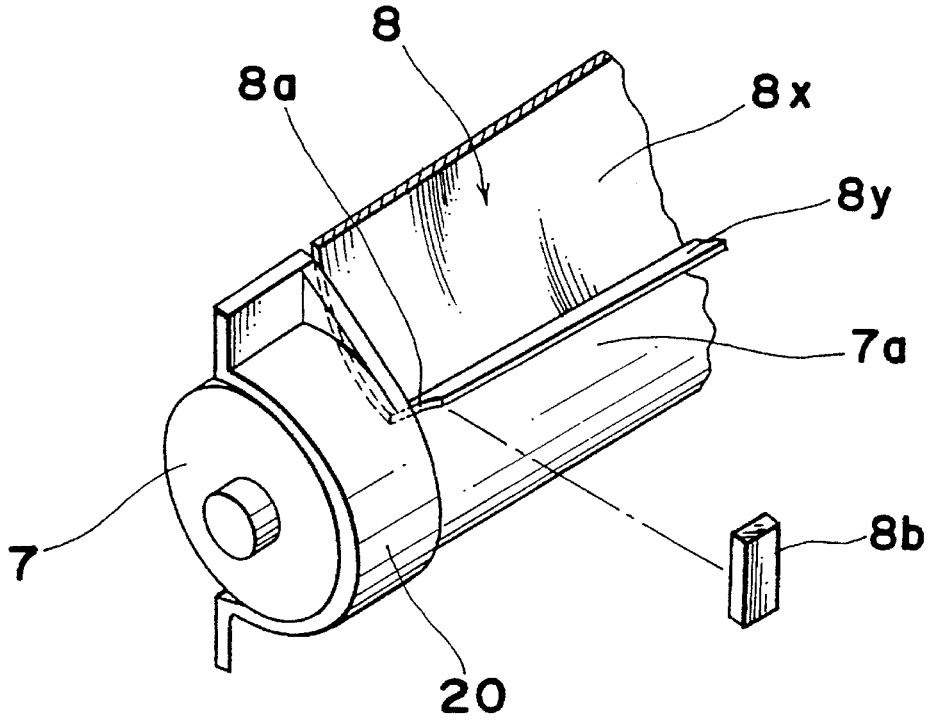
FIG. 5 is a fragmentary perspective view of one side portion of a developing apparatus, particularly showing regulation members and side sealings for concealing toner.
Figure 6:
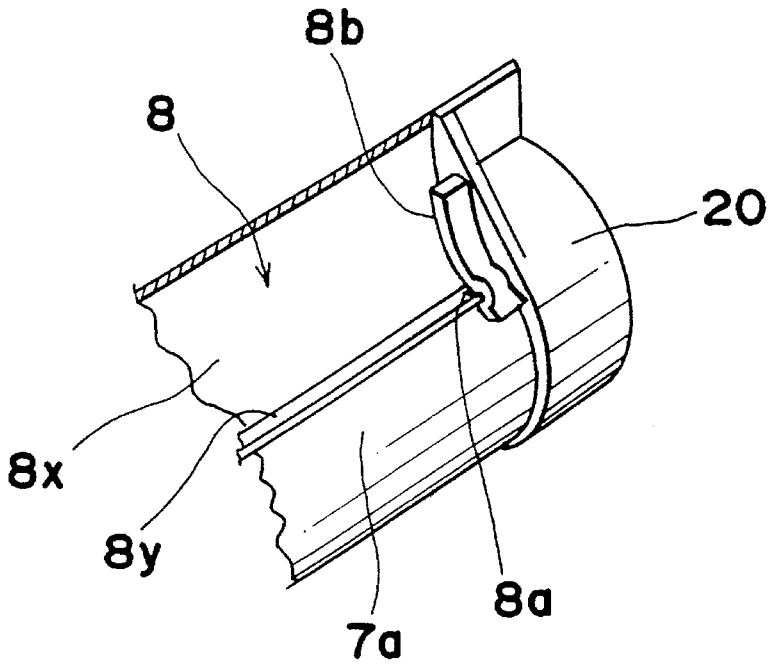
FIG. 6 is a fragmentary perspective view of another side portion of a developing apparatus, particularly showing regulation members for concealing toner.

Referring to FIGS. 5 and 6, a modification is shown. In this modification, the regulation member 8 has a recess 8*a* formed at each opposite end of the bent portion 8*y* so as to pressure fittingly insert an elastic block 8*b* made of an elastic material such as "molt plane" in the recess 8*a*, as best shown in FIG. 6, so as to conceal and prevent toner from flowing through the clearance between side sealing 20 and the side edge of regulation member 8. At the recess 8*a*, the reduced bent distance between the bent corner to the bottom edge of the recess 8*a* should preferably be between 0.3 mm and 1 mm. If the reduced bent distance is made greater than the above range, the clearance between the regulation member 8 and elastic block 8*b* becomes relatively large to permit the toner to pass therethrough freely. If the reduced bent distance is made smaller than the above range, the bending at the bottom of the recess may not be properly effected such that the edge at the bottom of the recess may directly contact the roller surface 7*a* resulting in damage, torque increase or rotation trouble of the roller 7.

Figure 7:
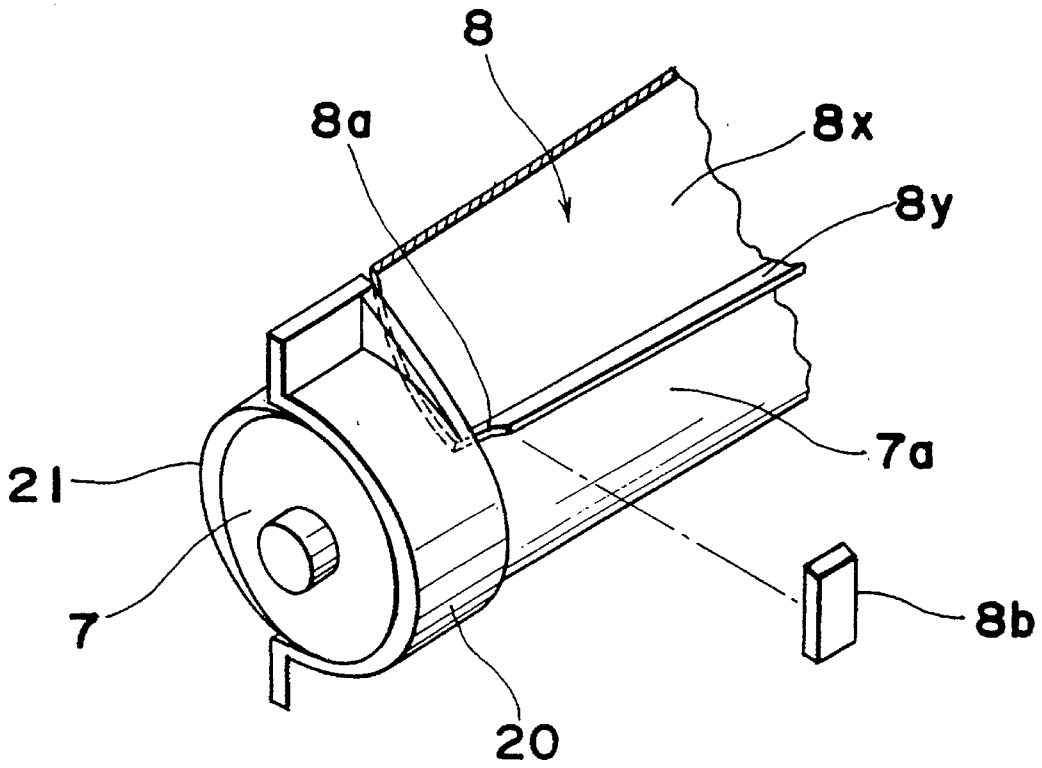
FIG. 7 is a fragmentary perspective view according to a modification of the developing apparatus shown in FIG. 5.

Referring to FIG. 7, another modification of the present invention is shown. In the modification of FIG. 7, a circular film 21 having a size slightly greater than the circumference of the roller 7 is applied. The regulating member 8 is held in contact with the film 21.

The present invention is also applicable to the developing apparatus utilizing a developing roller with carriers provided on the roller surface 7*a* to receive toner from the toner source, wherein the toner is mixed with and adhered to the carriers, and regulation is effected on the carriers.

As is clear from the foregoing description, since the regulating member 8 is held in contact with the roller surface 7*a* at the predetermined contacting area 9, the charging level and the thickness of the toner layer after the contacting area 9 can be obtained with less variation.

Furthermore, since the contacting pressure per unit area at the contacting area 9 can be made relatively low, the toner may not be rigidly adhered to the roller surface 7*a*.

Also, since the bent portion 8*y* is formed, the linearity along the contacting area 9 in the axial-wise direction can be obtained. Thus, the thickness of the toner layer as formed by the regulating member 8 can be maintained constant throughout the axial-wise direction on the roller surface 7*a*.

Moreover, since the variation of the length $\Delta L$ may not change the toner amount M ($mg/cm^2$) adhering on a unit area of roller surface 7*a* immediately after passing through the contacting area 9, the regulating member 8 can be formed with less preciseness, resulting in simple manufacturing steps.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A developing apparatus for developing an electrostatic latent image on an electrostatic latent image carrier comprising:

a developing member having an outer surface for retaining an electrostatically charged toner thereon and being provided rotatably in a predetermined direction; and a regulating blade formed by a plate which has a fixedly disposed one end and an opposing free end, said plate being bent in the vicinity of the free end in a direction away from the developing member so as to form a bent portion, said bent portion having a first flat portion extending in a substantially tangential direction with respect to the surface of the developing member, a bent corner extending in a direction away from the developing member, and a second flat portion connected to said first flat portion through said bent corner, said bent corner having a round curvature shape and a curvature radius no greater than 0.5 mm, a length measured from the bent corner to the free end being 0.5 to 5 mm, said bent portion being located upstream of said fixedly disposed one end with reference to the direction of rotation of said developing member.

2. A developing apparatus according to claim 1, wherein said plate is a metallic blade.

3. A developing apparatus of claim 2, wherein a thickness of the metallic blade is between 0.05 mm and 0.15 mm.

4. A developing apparatus of claim 1 further comprising a sealing member which is located downstream of a developing region with reference to the direction of rotation of said developing member.

5. A developing apparatus according to claim 1, wherein said regulating blade has a recess formed at each opposite end of said bent portion.

6. A developing apparatus for developing an electrostatic latent image on an electrostatic latent image carrier comprising:

a developing member having an outer surface for retaining an electrostatically charged toner thereon and being provided rotatably in a predetermined direction;

a regulating blade formed by a plate which has a fixedly disposed one end and an opposing free end, said plate being bent in the vicinity of the free end in a direction away from the developing member so as to form a bent portion, said bent portion having a first flat portion extending in a substantially tangential direction with respect to the surface of the developing member, a bent corner extending in a direction away from the developing member, and a second flat portion connected to said first flat portion through said bent corner, said bent corner having a round curvature shape and a curvature radius no greater than 0.5 mm, a length measured from the bent corner to the free end being 0.5 to 5 mm, said bent portion being located upstream of said fixedly disposed one end with reference to the direction of said developing member, and a toner supplying member provided rotatably in a predetermined direction and supplying said developing member with a toner.

7. A developing apparatus according to claim 6, wherein said toner supplying member and said developing member rotate in the same direction.

8. A developing apparatus according to claim 6, wherein said plate is a metallic blade.

9. A developing apparatus according to claim 8, wherein a thickness of the metallic blade is between 0.05 mm and 0.15 mm.

10. A developing apparatus according to claim 6 further comprising a sealing member which is located downstream of a developing region with reference to the direction of rotation of said developing member.

11. A developing apparatus according to claim 6, wherein said regulating blade has a recess formed at each opposite end of said bent portion.

12. A developing apparatus for developing an electrostatic latent image on an electrostatic latent image carrier comprising:

a casing having a partition inside thereof and divided into a first room and a second room by the partition said first room storing a toner;

a developing member having an outer surface for retaining an electrostatically charged toner thereon and being provided rotatably in a predetermined direction in the second room; and a regulating blade provided in the second room and formed by a plate which has a fixedly disposed one end and an opposing free end, said plate being bent in the vicinity of the free end in a direction away from the developing member so as to form a bent portion, said bent portion having a first flat portion extending in a substantially tangential direction with respect to the surface of the developing member, a bent corner extending in a direction away from the developing member, and a second flat portion connected to said first flat portion through said bent corner, said bent corner having a round curvature shape and a curvature radius no greater than 0.5 mm, a length measured from the bent corner to the free end being 0.5 to 5 mm, said bent portion being located upstream of said fixedly disposed one end with reference to the direction of rotation of said developing member.

13. A developing apparatus according to claim 12 further comprising an agitator which is provided in said first room for stirring the toner and sending the same to the second room.

14. A developing apparatus according to claim 13, wherein said agitator and said developing member rotate in the opposite direction.

15. A developing apparatus according to claim 12 further comprising at toner supplying member which is provided rotatably in a predetermined direction in the second room and supplying said developing member with the toner.

16. A developing apparatus according to claim 15, wherein said toner supplying member and said developing member rotate in the same direction.

17. A developing apparatus according to claim 12, wherein said plate is a metallic blade.

18. A developing apparatus according to claim 17, wherein a thickness of the metallic blade is between 0.05 mm and 0.15 mm.

19. A developing apparatus according to claim 12 further comprising a sealing member which is located downstream of a developing region with reference to the direction of rotation of said developing member.

20. A developing apparatus according to claim 12, wherein said regulating blade has a recess formed at each opposite end of said bent portion.

21. A developing apparatus for developing an electrostatic latent image on an electrostatic latent image carrier comprising:

a developing member having an outer surface for retaining an electrostatically charged toner thereon and being provided rotatably in a predetermined direction; and a regulating blade formed by a plate which has a fixedly disposed first end section and an opposing free second end section contacting said outer surface, said second end section including a first flat portion extending in a substantially tangential direction with respect to said outer surface, a bent corner extending from said first flat portion in a direction away from said developing member, and a second flat portion connected to said first flat portion through said bent corner, said bent corner having a round curvature shape and a curvature radius no greater than 0.5 mm, a length measured from the bent corner to the free end being greater than about 0.5 mm, said second end section being located upstream of said fixedly disposed one end with reference to the direction of rotation of said developing member.

22. The developing apparatus according to claim 21, wherein said first flat portion contacts said outer surface.

23. The developing apparatus according to claim 21, wherein said length measured from the bent corner to the free end is no greater than about 5 mm.

24. A developing apparatus for developing an electrostatic latent image on an electrostatic latent image carrier comprising:

a developing member having an outer surface for retaining an electrostatically charged toner thereon and being provided rotatably in a predetermined direction; and a regulating blade formed by a plate which has a fixedly disposed one end and an opposing free end, said plate being bent in the vicinity of the free end in a direction away from the developing member so as to form a bent portion, said bent portion having a first flat portion contacting said outer surface of said developing member and extending in a substantially tangential direction with respect to said outer surface, a bent corner extending in a direction away from said developing member, and a second flat portion connected to said first flat portion through said bent corner, said bent corner having a round curvature shape and a curvature radius no greater than 0.5 mm, a length measured from the bent corner to the free end being 0.5 to 5 mm, said bent portion being located upstream of said fixedly disposed one end with reference to the direction of rotation of said developing member.

* * * * *